US010531704B2

(12) United States Patent
Ko

(10) Patent No.: US 10,531,704 B2
(45) Date of Patent: Jan. 14, 2020

(54) RAIN BOOT AND UNIFORM FOOTWEAR WITH INTELLIGENT TEMPERATURE-CONTROLLING AIR EXTRACTOR AND WATER-PROOFING AND AIR-VENTING FUNCTIONS

(71) Applicant: SAMBO GROUP LIMITED, Hong Kong (CN)

(72) Inventor: WaiYip Ko, Hong Kong (CN)

(73) Assignee: SAMBO GROUP LIMITED, Hong Kong (CN)

( * ) Notice: Subject to any disclaimer, the term of this patent is extended or adjusted under 35 U.S.C. 154(b) by 0 days.

(21) Appl. No.: 16/063,253

(22) PCT Filed: Dec. 15, 2016

(86) PCT No.: PCT/CN2016/110113
§ 371 (c)(1),
(2) Date: Jun. 16, 2018

(87) PCT Pub. No.: WO2017/101812
PCT Pub. Date: Jun. 22, 2017

(65) Prior Publication Data

US 2018/0360160 A1 Dec. 20, 2018

(30) Foreign Application Priority Data

Dec. 18, 2015 (CN) ..... 2015 2 1064492 U

(51) Int. Cl.
*A43B 7/06* (2006.01)
*A43B 7/08* (2006.01)
(Continued)

(52) U.S. Cl.
CPC ..... *A43B 7/081* (2013.01); *A43B 1/0045* (2013.01); *A43B 3/0005* (2013.01);
(Continued)

(58) Field of Classification Search
CPC ..... A43B 1/0045; A43B 1/02; A43B 3/0005; A43B 3/0015; A43B 7/12; A43B 7/06; A43B 7/082
(Continued)

(56) References Cited

U.S. PATENT DOCUMENTS 5,500,635 A * 3/1996 Mott ..... A43B 1/0072 310/311
2004/0118831 A1* 6/2004 Martin ..... A43B 3/0005 219/494

(Continued)

*Primary Examiner* — Marie D Bays

(57) ABSTRACT

A rain boot and uniform footwear with an intelligent temperature-controlling air extractor and water-proofing and air-venting functions, includes: a boot upper layer (10), a middle cushion layer (11) and a boot lower layer (12), wherein a miniature air extractor (13) is provided at a position below an instep of the boot bottom layer (12), a magnetic levitation power switch (14), a temperature sensor (15) and a control main board (16) are also provided in the boot bottom layer (12), the temperature sensor (15) being electrically connected to an input end of the control main board (16) and transmitting a temperature sensing signal of the foot to the control main board (16), and an output end of the control main board (16) being electrically connected to the miniature air extractor (13) via the magnetic levitation power switch (14).

7 Claims, 2 Drawing Sheets

(51) Int. Cl.

| | |
|---|---|
| ***A43B 3/00*** | (2006.01) |
| ***A43B 1/00*** | (2006.01) |
| ***A43B 3/02*** | (2006.01) |
| ***A43B 7/12*** | (2006.01) |
| ***A43B 13/12*** | (2006.01) |
| ***A43B 13/38*** | (2006.01) |
| ***A43B 13/40*** | (2006.01) |
| ***A43B 23/02*** | (2006.01) |
| *A43B 1/02* | (2006.01) |

(52) U.S. Cl.
CPC ..... *A43B 3/0015* (2013.01); *A43B 3/02* (2013.01); *A43B 7/06* (2013.01); *A43B 7/082* (2013.01); *A43B 7/12* (2013.01); *A43B 13/12* (2013.01); *A43B 13/386* (2013.01); *A43B 13/40* (2013.01); *A43B 23/026* (2013.01); *A43B 1/02* (2013.01)

(58) Field of Classification Search
USPC ..... 36/3 R, 3 B
See application file for complete search history.

(56) References Cited

U.S. PATENT DOCUMENTS

| | | | | |
|---|---|---|---|---|
| 2005/0060906 | A1* | 3/2005 | Zimerfeld | A43B 3/0005 36/3 R |
| 2005/0235523 | A1* | 10/2005 | Flechsig | A43B 7/081 36/3 R |
| 2009/0113762 | A1* | 5/2009 | Leimer | A43B 3/0005 36/114 |
| 2017/0208890 | A1* | 7/2017 | Torvinen | A43B 3/0015 |
| 2018/0055140 | A1* | 3/2018 | Antonetti | A43B 7/02 |
| 2019/0159546 | A1* | 5/2019 | Cohen | A43B 7/005 |

* cited by examiner

RAIN BOOT AND UNIFORM FOOTWEAR WITH INTELLIGENT TEMPERATURE-CONTROLLING AIR EXTRACTOR AND WATER-PROOFING AND AIR-VENTING FUNCTIONS

CROSS REFERENCE OF RELATED APPLICATION

This is a U.S. National Stage under 35 U.S.C 371 of the International Application PCT/CN2016/110113, filed Dec. 15, 2016, which claims priority under 35 U.S.C. 119(a-d) to CN 201521064492.7, filed Dec. 18, 2015.

BACKGROUND OF THE PRESENT INVENTION

Field of Invention

The present invention relates to the technical field of rain boot and uniform footwear, and more particularly to a rain boot and uniform footwear with intelligent temperature-controlling air extractor and water-proofing and air venting functions.

Description of Related Arts

The rain boots and uniform footwear in the conventional arts are all made of rubber or plastic materials. The material is made into closed shoes, so that the shoes are completely not breathable, nor can the air inside the shoes be discharged. There are approximately 250,000 sweat glands on the feet of the human body. For the closed work shoes or sports shoes, 450 ml per day of sweat will be produced on the feet. A small part of the sweat will not evaporate within a short time and will remain inside your shoes as a good breeding ground for bacteria. Although there are already some breathable and waterproof soles on the market that are disclosed in U.S. Pat. Nos. 6,655,048 and 6,681,500, the focus is on the use of breathable membranes that are connected to a waterproof and breathable function. The breathability of these waterproofing membranes is approximately 300.000 kPa. 0*s/m to 700.000 kPa*s/m.

Based on the above description, the structure of rain boots and uniform footwear on the market can no longer meet the needs of the market.

SUMMARY OF THE PRESENT INVENTION

In view of the shortcomings in the conventional arts, the present invention provides a rain boot and uniform footwear with intelligent temperature-controlling air extractor and water-proofing and air venting functions, which has waterproof, exhaust, moisture permeable and deodorant functions.

A rain boot and uniform footwear with intelligent temperature-controlling air extractor and water-proofing and air venting functions comprising: a boot upper layer, a middle cushion layer and a boot lower layer; wherein a bottom surface of the middle cushion layer is fixedly fitted with the boot lower layer; the boot upper layer is fixedly connected with the boot lower layer, and the middle cushion layer is provided in a cavity enclosed by the boot upper layer and the boot lower layer; a miniature air extractor is provided inside of the boot lower layer, a magnetic levitation power switch, a temperature sensor and a control main panel are provided inside the boot lower layer; the temperature senor is electrically connected with an input terminal of the control main board to send a temperature sensing signal at a foot portion to the control main board, an output terminal of the control main board is electrically connected with the miniature air extractor via a magnetic levitation power switch; a piezoelectric plate and a storage battery which is electrically connected with the magnetic levitation power switch is provided inside a heel on a rear portion of the boot lower layer; the piezoelectric plate is electrically connected with the storage battery, and the piezoelectric plate generates currents and stores the currents in the storage battery.

Preferably, a flexible solar panel electrically connected with the storage battery is laid on a rear external surface of the boot lower layer; the flexible solar panel absorbs light energy and converts the light energy into electrical energy and stores the electrical energy in the storage battery.

Preferably, the magnetic levitation power switch comprises a first magnet and a second magnet are magnetically contactable and distributed in parallel up and down; the miniature air extractor comprises a motor and a ventilation fan which is in driving connection with the motor; the first magnet is connected with a first negative wire of the motor; the second magnet is connected with a second negative wire of the storage battery; the first magnet is pressed downwardly to be attached with the second magnet, in such a manner that the motor is energized to drive the ventilation fan to operate.

Preferably, Nylon fiber network is provided between the boot upper layer; the boot lower layer comprises a medium sole and a large sole; a first air vent and elastic buffer sponge are provided on a front end of the large sole; a second air vent is provided on a forefoot position of the medium sole; the first air vent is covered with breathable and waterproof long-fiber nonwoven which is performed with anti-siphon treatment; the miniature air extractor, the magnetic levitation power switch, the storage battery, the temperature sensor, the control main board and the piezoelectric plate are all provided in the medium sole; a bleeder hole is opened on a side of the medium sole for discharging moisture in the boots.

Preferably, a first side of the Nylon fiber network is adhered with the seamless boot which is formed by spinning and weaving with yarns finished by Nano-silica gel; and a second side of the Nylon fiber network is adhered with ventilate bamboo fabric lining; wherein the seamless boot, the Nylon fiber network and the ventilate bamboo fabric lining are laminated from outside to inside.

Preferably, the middle cushion layer comprises: three-dimensional fabric, high elasticity sponge and bamboo fiber cloth; wherein the three-dimensional fabric, the high elasticity sponge and the bamboo fiber cloth are sequentially attached from top to bottom.

Preferably, a plurality of air holes are uniformly provided on a middle portion of the medium sole for discharging air inside the boots; wherein an internal diameter of each of the plurality of air holes is smaller than an internal diameter of the second air vent.

Beneficial effects of the present invention are as follows. Compared with the conventional arts, the present invention provides a rain boot and uniform footwear with intelligent temperature-controlling air extractor and water-proofing and air venting functions; wherein the miniature air extractor, the magnetic levitation power switch and the temperature sensor are provided inside the boot lower layer. The temperature sensor is capable of sensing temperatures of the boots in real time. When the temperature is higher than a comfort temperature value, the miniature air extractor can be turned on for bleeding in the boots; when the temperature is lower than the comfort temperature value, operation of the miniature air extractor is automatically terminated, so as to ensure that the temperature in the boots is always within the comfort temperature value. The magnetic levitation power switch is configured to be automatically turned off when the boots are not weared, so all micro-elements in the boots are not working; when the boots are weared, the magnetic levitation power switch is turned on; in such a manner that an object of automatically controlling the power switch is achieved, which has an effect of energy saving. A piezoelectric plate made of piezoelectric material is provided. Continuously pressing the piezoelectric plate while walking is capable of generating an electric field due to mechanical deformation to form current for storing in a battery, so as to supply power for all the electric components for working under conditions without sunlight. The improvement in the structure mentioned above is capable of rapidly discharging sweat and moisture in the boots. The boots of the present invention are suitable for people wearing uniform shoes or outdoor shoes under hot or high temperature work, thereby maintaining good internal air circulation in the shoes.

These and other objectives, features, and advantages of the present invention will become apparent from the following detailed description, the accompanying drawings, and the appended claims.

References of main elements are as follows.

10—boot upper layer; 11—middle cushion layer; 12—boot lower layer; 13—miniature air extractor; 14—magnetic levitation power switch; 15—temperature sensor; 16—main control board; 17—piezoelectric plate; 18—storage battery; 19—flexible solar panel; 20—bleeder hole; 101—Nylon fiber network; 102—seamless boot; 103—bamboo fabric lining; 111—three—dimensional fabric; 112—high elasticity sponge; 113—bamboo fiber cloth; 121—medium sole; 122—large sole; 141—first magnet; 142—second magnet; 1211—second air vent; 1212—air hole; 1221—first air vent; 1222—elastic buffer sponge; 1223—long-fiber nonwovens.

DETAILED DESCRIPTION OF THE PREFERRED EMBODIMENT

In order to illustrate the present invention more clearly, further description of the present invention is further illustrated combining with the accompanying drawings.

Figure 1:
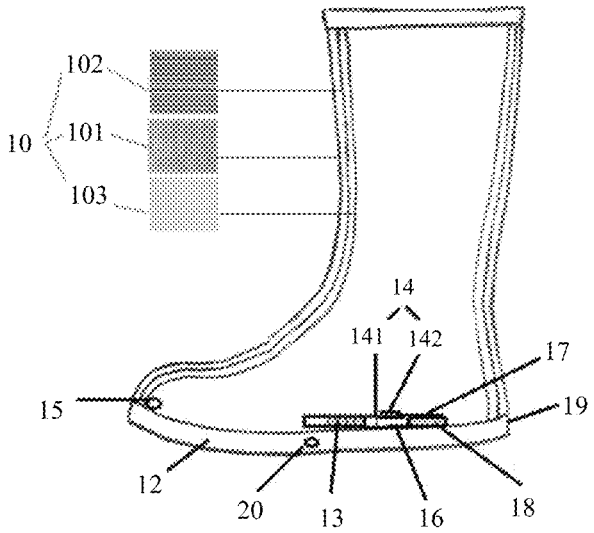
FIG. 1 is a structural view of a rain boot and uniform footwear with intelligent temperature-controlling air extractor and water-proofing and air-venting functions according to a preferred embodiment of the present invention.

Referring to FIG. 1, a rain boot and uniform footwear with intelligent temperature-controlling air extractor and water-proofing and air venting functions comprises: a boot upper layer 10, a middle cushion layer 11 and a boot lower layer 12; wherein a bottom surface of the middle cushion layer 11 is fixedly fitted with the boot lower layer 12; the boot upper layer 10 is fixedly connected with the boot lower layer 12, and the middle cushion layer 11 is provided in a cavity enclosed by the boot upper layer 10 and the boot lower layer 12; a miniature air extractor 13 is provided inside of the boot lower layer 12, a magnetic levitation power switch 14, a temperature sensor 15 and a control main panel 16 are provided inside the boot lower layer 12; the temperature senor 15 is electrically connected with an input terminal of the control main board 16 to send a temperature sensing signal at a foot portion to the control main board 16, an output terminal of the control main board 16 is electrically connected with the miniature air extractor 13 via a magnetic levitation power switch 14; a piezoelectric plate 17 and a storage battery 18 which is electrically connected with the magnetic levitation power switch 14 is provided inside a heel on a rear portion of the boot lower layer 12; the piezoelectric plate 17 is electrically connected with the storage battery 18, and the piezoelectric plate 17 generates currents and stores the currents in the storage battery 18.

Compared with the situation in the prior art, the present invention provides a rain boot and uniform footwear with intelligent temperature-controlling air extractor and water-proofing and air venting functions, wherein the miniature air extractor 13, the magnetic levitation power switch 14 and the temperature senor 15 are provided inside the boot lower layer 12; the temperature senor 15 is capable of sensing temperatures of the boots in real time. When a temperature is higher than a comfortable temperature value, operation of the miniature air extractor 13 is automatically terminated, in such a manner that temperatures inside the boots are always within the comfortable temperature value. The magnetic levitation power switch 14 is configured to be automatically turned off when the boots are not weared, so all micro-elements in the boots are not working; when the boots are weared, the magnetic levitation power switch 14 is turned on; in such a manner that an object of automatically controlling the power switch is achieved, which has an effect of energy saving. A piezoelectric plate made of piezoelectric material is provided. Continuously pressing the piezoelectric plate 17 while walking is capable of generating an electric field due to mechanical deformation to form current for storing in a battery, so as to supply power for all the electric components for working under conditions without sunlight. The improvement in the structure mentioned above is capable of rapidly discharging sweat and moisture in the boots. The boots of the present invention are suitable for people wearing uniform shoes or outdoor shoes under hot or high temperature work, thereby maintaining good internal air circulation in the shoes.

In the preferred embodiment, a flexible solar panel 19 electrically connected with the storage battery 18 is laid on a rear external surface of the boot lower layer 12. The flexible solar panel 19 absorbs light energy and converts the light energy into electrical energy and stores the electrical energy in the storage battery 18. The flexible solar panel 19 supplies power to the boots surface, serves as a decorative design and cooperates with the piezoelectric effect of the piezoelectric plate. The piezoelectric plate utilizes a phenomenon in which the mechanical energy and the electrical energy are exchanged in the material. The phenomenon was first discovered by brothers Pierre Curie and Jacques Curie in 1880. Piezoelectric materials can generate electric fields due to mechanical deformation and can also supply electricity in the absence of sunlight. The above power supply structure keeps the boots in a powered state.

According to the preferred embodiment of the present invention, the magnetic levitation power switch 14 comprises a first magnet 141 and a second magnet 142 are magnetically contactable and distributed in parallel up and down; the miniature air extractor 13 comprises a motor and a ventilation fan which is in driving connection with the motor. The first magnet 141 is connected with a first negative wire of the motor; the second magnet 142 is connected with a second negative wire of the storage battery 18; the first magnet 141 is pressed downwardly to be attached with the second magnet 142, in such a manner that the motor is energized to drive the ventilation fan to operate.

Figure 2:
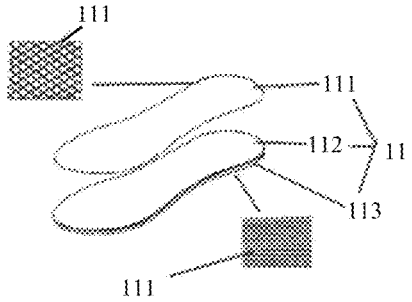
FIG. 2 is an exploded view of a middle cushion layer according to a preferred embodiment of the present invention.
Figure 3:
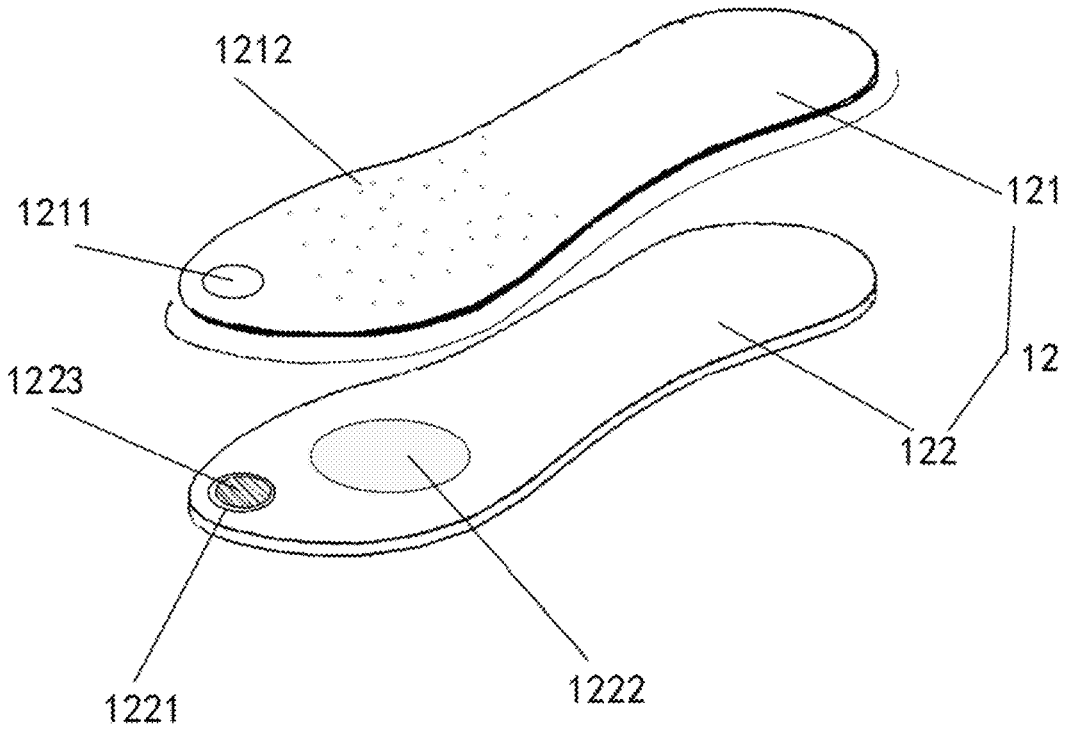
FIG. 3 is an exploded view of a boot lower layer according to a preferred embodiment of the present invention.

Further referring to FIGS. 2-3, Nylon fiber network 101 is provided between the boot upper layer 10; the boot lower layer 12 comprises a medium sole 121 and a large sole 122; a first air vent 1221 and elastic buffer sponge 1222 are provided on a front end of the large sole 122; a second air vent 1211 is provided on a forefoot position of the medium sole 121. The first air vent 1221 is covered with breathable and waterproof long-fiber nonwoven 1223 which is performed with anti-siphon treatment. In the present invention, elastic buffer sponge is provided for shock absorption. The air vent allows the air and moisture inside the boots to be effectively discharged. The miniature air extractor 13, the magnetic levitation power switch 14, the storage battery 18, the temperature sensor 15, the control main board 16 and the piezoelectric plate 17 are all provided in the medium sole 121; a bleeder hole 20 is opened on a side of the medium sole 121 for discharging moisture in the boots.

Compared with the conventional arts, the rain boot and uniform footwear with intelligent temperature-controlling air extractor and water-proofing and air venting functions provided by the present invention comprises: three layers of a boot upper layer 10, a middle cushion layer 11 and a boot lower layer 12. By a structure of the three layers, the Nylon fiber network 101 inside the boot upper layer 10 is a compressive layer, so as to offset impacts of rain, which is capable of effectively preventing rain from seeping into interior of the rain boots and the uniform footwear, and also capable of circulating the air, so as to replace the two types of boots in the conventional arts that fail to have effects of moisture permeability and air exhaust. In addition, air vent and buffer elastic sponge are provided on the boot lower layer 12, a breathable long-fiber non-woven fabric is covered on the first air vent. Improvement of the structure can prevent dust and rain from entering the inside of the rain boots or the uniform footwear, thereby realizing that the rain boots and the uniform footwear have the effect of waterproof and exhaust, so as to maintain a good internal air circulation and reduce pressure buffer and shock absorption of the foot while walking. The boots and the uniform footwear provided by the present invention only have differences in shapes, structures thereof are identical. In addition, the two kinds of boots have functions of waterproof, exhaust, moisture permeability, deodorization, cushioning and shock absorption, high comfort and practicality. At the same time, the product of the present invention has a wide range of applications and can be applied to all kinds of rain boots and uniform footwear.

In the preferred embodiment, a first side of the Nylon fiber network 101 is adhered with the seamless boot 102 which is formed by spinning and weaving with yarns finished by Nano-silica gel; and a second side of the Nylon fiber network 101 is adhered with ventilate bamboo fabric lining 103; wherein the seamless boot 102, the Nylon fiber network 101 and the ventilate bamboo fabric lining 103 are laminated from outside to inside. The FIG. 2 shows a specific structure of the corresponding seamless boot 102, the Nylon fiber network 101 and the ventilate bamboo fabric lining 103. The middle cushion layer 11 comprises: three-dimensional fabric 111, high elasticity sponge 112 and bamboo fiber cloth 113; wherein the three-dimensional fabric 111, the high elasticity sponge 112 and the bamboo fiber cloth 113 are sequentially attached from top to bottom. Lining of the bamboo fiber cloth can also be formed by finishing the Fluoropolymer, wherein the Fluoropolymer is fluoropolymer. The bamboo fabric lining formed by finishing the Fluoropolymer has the function of anti-siphon and air permeability.

In the preferred embodiment, a plurality of air holes 1212 are uniformly provided on a middle portion of the medium sole 121 for discharging air inside the boots; wherein an internal diameter of each of the plurality of air holes 1212 is smaller than an internal diameter of the second air vent 1211. Design of the air holes makes the rain boot and uniform footwear have better exhaust and moisture permeability effects. In addition, a small mini exhaust fan can be provided in the bottom of the boots according to the requirements of the production technician.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rain boot and uniform footwear with intelligent temperature-controlling air extractor and water-proofing and air venting functions comprising: a boot upper layer, a middle cushion layer and a boot lower layer; wherein a bottom surface of the middle cushion layer is fixedly fitted with the boot lower layer; the boot upper layer is fixedly connected with the boot lower layer, and the middle cushion layer is provided in a cavity enclosed by the boot upper layer and the boot lower layer; a miniature air extractor is provided inside of the boot lower layer, a magnetic levitation power switch, a temperature sensor and a control main panel are provided inside the boot lower layer; the temperature senor is electrically connected with an input terminal of the control main board to send a temperature sensing signal at a foot portion to the control main board, an output terminal of the control main board is electrically connected with the miniature air extractor via a magnetic levitation power switch; a piezoelectric plate and a storage battery which is electrically connected with the magnetic levitation power switch is provided inside a heel on a rear portion of the boot lower layer; the piezoelectric plate is electrically connected with the storage battery, and the piezoelectric plate generates currents and stores the currents in the storage battery.

2. The rain boot and uniform footwear with intelligent temperature-controlling air extractor and water-proofing and air venting functions, as recited in claim 1, wherein a flexible solar panel electrically connected with the storage battery is laid on a rear external surface of the boot lower layer; the flexible solar panel absorbs light energy and converts the light energy into electrical energy and stores the electrical energy in the storage battery.

3. The rain boot and uniform footwear with intelligent temperature-controlling air extractor and water-proofing and air venting functions, as recited in claim 1, wherein the magnetic levitation power switch comprises a first magnet and a second magnet are magnetically contactable and distributed in parallel up and down; the miniature air extractor comprises a motor and a ventilation fan which is in driving connection with the motor; the first magnet is connected with a first negative wire of the motor; the second magnet is connected with a second negative wire of the storage battery; the first magnet is pressed downwardly to be attached with the second magnet, in such a manner that the motor is energized to drive the ventilation fan to operate.

4. The rain boot and uniform footwear with intelligent temperature-controlling air extractor and water-proofing and air venting functions, as recited in claim 1, Nylon fiber network is provided between the boot upper layer; the boot lower layer comprises a medium sole and a large sole; a first air vent and elastic buffer sponge are provided on a front end of the large sole; a second air vent is provided on a forefoot position of the medium sole; the first air vent is covered with breathable and waterproof long-fiber nonwoven which is performed with anti-siphon treatment; the miniature air extractor, the magnetic levitation power switch, the storage battery, the temperature sensor, the control main board and the piezoelectric plate are all provided in the medium sole; a bleeder hole is opened on a side of the medium sole for discharging moisture in the boots.

5. The rain boot and uniform footwear with intelligent temperature-controlling air extractor and water-proofing and air venting functions, as recited in claim 4, wherein a first side of the Nylon fiber network is adhered with the seamless boot which is formed by spinning and weaving with yarns finished by Nano-silica gel; and a second side of the Nylon fiber network is adhered with ventilate bamboo fabric lining; wherein the seamless boot, the Nylon fiber network and the ventilate bamboo fabric lining are laminated from outside to inside.

6. The rain boot and uniform footwear with intelligent temperature-controlling air extractor and water-proofing and air venting functions, as recited in claim 1, wherein the middle cushion layer comprises: three-dimensional fabric, high elasticity sponge and bamboo fiber cloth; wherein the three-dimensional fabric, the high elasticity sponge and the bamboo fiber cloth are sequentially attached from top to bottom.

7. The rain boot and uniform footwear with intelligent temperature-controlling air extractor and water-proofing and air venting functions, as recited in claim 4, wherein a plurality of air holes are uniformly provided on a middle portion of the medium sole for discharging air inside the boots; wherein an internal diameter of each of the plurality of air holes is smaller than an internal diameter of the second air vent.

* * * * *